United States Patent [19]

Voorhees

[11] 3,990,457

[45] Nov. 9, 1976

[54] PODIATRIC INSOLE

[75] Inventor: John L. Voorhees, Phoenix, Ariz.

[73] Assignee: Curiel Products Corporation, Scottsdale, Ariz.

[22] Filed: Aug. 14, 1975

[21] Appl. No.: 604,648

[52] U.S. Cl. ..... 128/594

[51] Int. Cl.[2] ..... A61F 5/14

[58] Field of Search ..... 128/594, 595; 36/2.5, 3, 29, 71

[56] References Cited

UNITED STATES PATENTS

| | | | |
|---|---|---|---|
| 1,145,533 | 7/1915 | Wetmore | 128/594 |
| 2,477,588 | 8/1949 | Dumm | 128/594 |
| 2,488,382 | 11/1949 | Davis | 128/594 |
| 2,645,865 | 7/1953 | Town | 128/594 |
| 2,762,134 | 9/1956 | Town | 128/594 |
| 3,765,422 | 10/1973 | Smith | 128/594 |

*Primary Examiner*—John D. Yaske

*Attorney, Agent, or Firm*—Cahill, Sutton & Thomas

[57] ABSTRACT

A podiatric insole is disclosed comprising two layers of flexible material sealed along the outer edges thereof and provided with three substantially transverse walls to thereby provide a compartmentalized structure having four non-communicating compartments. Each of the compartments is provided with a liquid such as water and incorporates a unique volume of liquid per unit area of the compartment. Each of the compartments provides the proper cushioning for that portion of the foot which it supports.

6 Claims, 2 Drawing Figures

PODIATRIC INSOLE

Figure 1:
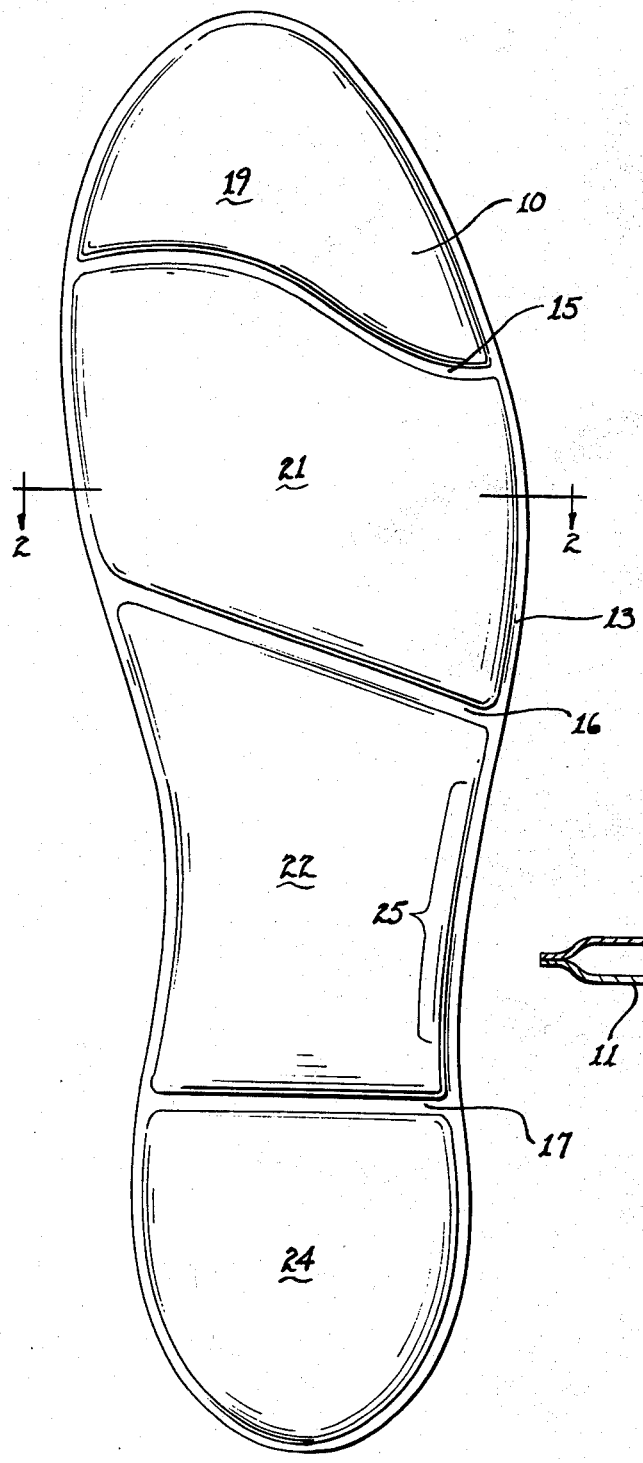

The present invention pertains to a podiatric insole and more particularly to a liquid-filled insole utilized as a cushion to be positioned in contact with the bottom of a user's foot.

The desirability of providing a cushioning surface for the bottom of the foot has long been recognized. Several prior art patents exist relating to cushioning materials and insole structures. For example, U.S. Pat. No. 2,477,588 (Dumm) describes a hydraulic insole formed by opposing sheets of flexible material and incorporating non-communicating compartments therein. However, the compartments provided by Dumm do not correspond to the major pressure points of the user's foot and, except for the area beneath the toes, are formed by essentially longitudinally extending walls. Further, only a specific compartment is provided with a liquid, and the viscosity of the liquid is that of homogenized honey. While the Dumm patent represents an advance over the then-existing prior art, the problem still exists of the accommodation of the differing requirements of the different portions of the user's foot.

Another example of the prior art is U.S. Pat. No. 3,765,422 to Smith. Smith suggests the provision of a transverse wall, in a fluid cushion podiatric insole, positioned along the forward edges of the metatarsal pressure points of the foot; thus, the positioning of the wall represents a recognition of the requirement for limiting fluid flow in the area of the metatarsus. However, Smith does not solve the problem of the differing cushioning requirements of the various other portions of the foot.

Body weight is transmitted through the seven tarsal and five metatarsal bones to the weight-bearing surfaces of the foot. The weight is received by the talus positioned on the lower end of the tibia and the lines of force created by the weight extend downward and backward to the os calcis, or heel, and also extend downward and forward to the forefoot. The weight is generally distributed through the longitudinal and transverse arches predominantly to three weight-bearing areas. These areas include the tuberosity of the os calcis, the head of the first metatarsal and the outer border of the foot. The phalanges do not carry a significant portion of the total weight but do provide pressure points under non-static conditions such as walking or running.

It was previously believed that the overall slope of the foot was basically determined by the muscles and ligaments maintaining the bones in proper relationship with respect to one another; however, more recent studies have indicated that the shape of the foot is primarily determined by the interfitting of the respective bones and that the muscles and ligaments are called upon to retain the shape only during periods of high stress when the foot is subjected to forces in excess of the static weight of the individual. That is, those forces encountered during the initial movement of the foot when the individual steps forward or when the individual is running. Without regard to the nature of the shape of the foot, or the manner in which the shape is maintained, I have found that foot comfort can be enhanced by providing four separate cushioning areas to contact, respectively, the phalanges, the metatarasal pressure points, the arch and the tuberosity of the os calcis. The cushioning in each of these areas is important for maintaining overall comfort and preventing stress concentration that could produce damage to the foot.

It is therefore an object of the present invention to provide a podiatric insole having four distinct cushioning areas, each for cushioning a separate portion of the bottom of a user's foot.

It is also an object of the present invention to provide a podiatric insole utilizing a liquid such as water enclosed within four separate compartments for contacting four separate areas of the bottom of a user's foot.

It is still another object of the present invention to provide a podiatric insole incorporating a pair of flexible layers bonded along specific lines to form a compartmentalized structure, each compartment of which is non-communicating with the others and which contain a liquid, the volume of liquid per unit area of each compartment being determined by the requirements of that compartment.

Briefly, in accordance with the embodiment chosen for illustration, a pair of flexible sheets having the general outline of a user's foot are formed into a two-layered compartmentalized structure by bonding the layers along the outside edge thereof and by bonding the layers along walls extending substantially transversely of the wearer's foot. The walls are positioned to provide four separate non-communicating compartments each positioned beneath a portion of the foot and each provided with a different cushioning effect by the control of the liquid placed in each compartment.

The present invention may more readily be described by reference to the accompanying drawings in which FIG. 1 is a plan view of a podiatric insole constructed in accordance with the teachings of the present invention.

Figure 2:
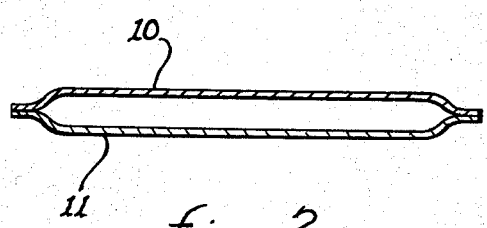

FIG. 2 is a cross-sectional view of FIG. 1 taken along line 2—2.

Referring now to the drawings, a first layer 10 of flexible material is cut to the general outline of the bottom of a user's foot. The outline is typical of shoe soles and insoles; a second layer 11, cut to the same shape, is bonded to the first along the outside edge 13 thereof. The flexible material from which layers 10 and 11 are made may be any of several well known rubber-like or plastic materials readily commercially available and which exhibit sufficient strength and toughness to withstand the pressures and abrasion encountered in use as an insole. The bonding of layers 10 and 11 may be accomplished using well established bonding techniques which form no part of the present invention and need not be discussed.

The layers 10 and 11 are also bonded together to form walls 15, 16 and 17. The wall 15 is positioned forward of the heads of the metatarsus and is generally transverse of the user's foot. The wall 15 is curved as shown to generally follow the contour, as viewed from above, of the metatarsal pressure points of the user. The wall 15 forms a compartment 19 which is forward of the metatarsus and generally provides cushioning for the phalanges.

The wall 16 is generally transverse of the user's foot but is somewhat angled and defines a compartment 21 that is generally positioned beneath the metatarsal pressure points. The wall 17 is transverse to the wearer's foot and separates compartment 22 from compartment 24. The compartment 22 is positioned beneath the arch of the foot; however, the compartment does not extend upward to contact and support the arch as suggested in the prior art; instead, the insole of the present invention relies on the arch of a shoe to provide major support to the arch of the foot. The compartment 22 only provides the proper cushioning. This cushioning is extremely important since the outer border of the foot along the border designated at 25 assists in the support of the weight of the user.

The compartment 24 is positioned beneath the os calcis, or heel, and cushions the foot of that area. Each of the compartments 19, 21, 22, and 24 contains liquid which may be water although other liquids such as alcohol may be found suitable. Usually, water is satisfactory and may contain chemicals such as an algacide. The weight or volume of the water used to fill the compartments has been found to greatly affect the comfort afforded by the present insole. For example, it was found that the comfort of the insole was enhanced when the weight or volume per unit area of the liquid in compartment 22 was essentially twice that in compartment 24. This relationship is quite unexpected since the weight borne by the os calcis in contact with compartment 24 is substantially greater than the weight borne by that portion of the foot in contact with compartment 22. Specifically, I have found the following values of liquid weight (using water as the liquid) per unit area of the respective compartments to be ideal for use by men and women:

| | | |
|---|---|---|
| For Men | | |
| | Compartment 19 | $6.2 \times 10^{-6}$ grams per square centimeter |
| | Compartment 21 | $15.5 \times 10^{-6}$ grams per square centimeter |
| | Compartment 22 | $21.7 \times 10^{-6}$ grams per square centimeter |
| | Compartment 24 | $10.9 \times 10^{-6}$ grams per square centimeter |
| For Women | | |
| | Compartment 19 | $4.7 \times 10^{-6}$ grams per square centimeter |
| | Compartment 21 | $13.9 \times 10^{-6}$ grams per square centimeter |
| | Compartment 22 | $18.6 \times 10^{-6}$ grams per square centimeter |
| | Compartment 24 | $9.3 \times 10^{-6}$ grams per square centimeter |

While the above weights per unit area were found to be substantially ideal, the following ranges will provide satisfactory cushioning for the various areas of the foot:

| | |
|---|---|
| Compartment 19 | $3 \times 10^{-6}$ to $8 \times 10^{-6}$ |
| Compartment 21 | $12 \times 10^{-6}$ to $17 \times 10^{-6}$ |
| Compartment 22 | $17 \times 10^{-6}$ to $24 \times 10^{-6}$ |
| Compartment 24 | $7 \times 10^{-6}$ to $13 \times 10^{-6}$ |

The specific values of liquid weight per unit area will depend to some extent on the shape and size of the user's foot. For example, I have found that slightly more liquid may be required in the compartment under the arch of a woman's foot relative to the same compartment under the arch of a man's foot. However, the above range of values are appropriate for the entire range of men's and women's foot sizes, assuming, of course, that the user's foot is normal.

I claim:

1. A podiatric insole comprising a. first and second substantially flat layers of flexible material each generally conforming to the outline of the bottom of a user's foot;

b. said layers being joined to each other i. along the edges thereof;

ii. along a line forward of the metatarsal pressure points;

iii. along a line substantially transverse of the user's foot and rearward of the metatarsal pressure points;

iv. along a line substantially transverse of the user's foot and forward of the os calcis area to form a compartmentalized enveloope having four separate non-communicating compartments beneath the phalanges, metatarsal pressure points, arch, and os calcis, respectively; and c. each of said compartments covering a predetermined area between said layers and each containing a predetermined volume of liquid per unit area.

2. The podiatric insole of claim 1, wherein at least two of said compartments contain differnt predtermined volumes of liquid per unit area.

3. The podiatric insole of claim 1, wherein said compartments each contain a different predetermined volume of liquid per unit area.

4. The podiatric insole of claim 1, wherein said liquid includes water and wherein a. the compartment beneath the phalanges of the user's foot contains from $3 \times 10^{-6}$ to $8 \times 10^{-6}$ grams of water per square centimeter;

b. the compartment beneath the metatarsal pressure points of the user's foot contains from $12 \times 10^{-6}$ to $17 \times 10^{-6}$ grams of water per square centimeter;

c. the compartment beneath the arch of the user's foot contains from $17 \times 10^{-6}$ to $24 \times 10^{-6}$ grams of water per square centimeter; and d. the compartment beneath the os calcis, or heel, of the user's foot contains $7 \times 10^{-6}$ to $13 \times 10^{-6}$ grams of water per square centimeter.

5. The podiatric insole of claim 1, wherein said liquid includes water and wherein a. the compartment beneath the phalanges of the user's foot contains from $6.2 \times 10^{-6}$ grams of water per square centimeter;

b. the compartment beneath the metatarsal pressure points of the user's foot contains from $15.5 \times 10^{-6}$ grams of water per square centimeter;

c. the compartment beneath the arch of the user's foot contains from $21.7 \times 10^{-6}$ grams of water per square centimeter; and d. the compartment beneath the os calcis, or heel, of the user's foot contains $10.9 \times 10^{-6}$ grams of water per square centimeter.

6. The podiatric insole of claim 1, wherein said liquid includes water and wherein the ratio of weight of water per unit area of the respective compartments are a. the compartment beneath the phalanges of the user's foot to the compartment beneath the metatarsal pressure points equals 0.4;

b. the compartment beneath the phalanges of the user's foot to the compartment beneath the arch equals 0.28; and c. the compartment beneath the phalanges of the user's foot to the compartment beneath the os calcis, or heel, equals 0.57.

* * * * *